US008510991B2

(12) United States Patent
Collene

(10) Patent No.: US 8,510,991 B2
(45) Date of Patent: Aug. 20, 2013

(54) FRENCH DOOR HINGE SYSTEM FOR OVEN

(75) Inventor: James J. Collene, Nevada, OH (US)

(73) Assignee: Mansfield Engineered Components, Inc., Mansfield, OH (US)

( * ) Notice: Subject to any disclaimer, the term of this patent is extended or adjusted under 35 U.S.C. 154(b) by 1263 days.

(21) Appl. No.: 12/315,715

(22) Filed: Dec. 5, 2008

(65) Prior Publication Data

US 2009/0145031 A1 Jun. 11, 2009

Related U.S. Application Data

(60) Provisional application No. 60/992,760, filed on Dec. 6, 2007.

(51) Int. Cl.
*E05F 17/00* (2006.01)

(52) U.S. Cl.
USPC ..... 49/116; 49/112; 312/405

(58) Field of Classification Search
USPC ..... 126/190–192, 194, 273 R, 1 R; 49/116, 49/112
See application file for complete search history.

(56) References Cited

U.S. PATENT DOCUMENTS

| | | | | |
|---|---|---|---|---|
| 2,707,225 | A | 4/1955 | Pearce | |
| 2,823,664 | A | 2/1958 | Evans et al. | |
| 2,889,825 | A | 6/1959 | Evans | |
| 3,009,458 | A | 11/1961 | Pearce | |
| 3,045,663 | A | 7/1962 | McDonnold | |
| 3,393,883 | A * | 7/1968 | Smith et al. | 244/102 R |
| 2,708,709 | A | 5/1995 | Pearce | |
| 7,755,004 | B2 * | 7/2010 | Collene et al. | 219/391 |
| 2007/0039605 | A1 | 2/2007 | Larsen | |
| 2007/0246036 | A1 * | 10/2007 | Larsen et al. | 126/190 |

* cited by examiner

*Primary Examiner* — Linda Dvorak
*Assistant Examiner* — Amanda Scott
(74) *Attorney, Agent, or Firm* — Fay Sharpe LLP

(57) ABSTRACT

A French door oven includes a body defining a cooking chamber with an open mouth. First and second doors are respectively connected to the body adjacent opposite first and second opposite lateral sides of the mouth and are adapted to pivot about respective first and second vertical pivot axes between an opened position in which the first and second doors are pivoted away from the mouth and a closed position in which the first and second doors cover the mouth and define a seam between their adjacent respective inner edges. The oven includes a door movement control system for controlling movement of the doors between their opened and closed positions. The door movement control system includes a door movement control plate including a door movement slot including an inner portion and an outer portion, the outer portion closer to the mouth than the inner portion.

23 Claims, 9 Drawing Sheets

FRENCH DOOR HINGE SYSTEM FOR OVEN

CROSS-REFERENCE TO RELATED APPLICATION

This application claims priority from and benefit of the filing date of U.S. provisional patent application Ser. No. 60/992,760 filed Dec. 6, 2007, and the entire disclosure of said provisional application is hereby expressly incorporated by reference into the present specification.

BACKGROUND

French door ovens are known, in which the mouth of an oven cooking chamber is selectively opened and closed by first and second oven doors respectively connected adjacent first and second lateral sides of the cooking chamber mouth. The first and second doors are pivotally connected to the oven body and pivot about respective first and second vertical axes. The respective inner edges of the doors meet and seal together at a seam when the doors are closed in order to cover the mouth of the cooking chamber.

Prior french door ovens have been deemed deficient with respect to the hinge system for controlling movement of the doors. In particular, a need has been identified for a french door hinge system for an oven in which the opening and closing movement of the doors is more effectively controlled to improve the heat seal between the doors and also to improve ease of use for operators. Also, it has been deemed desirable to provide a french door hinge system that can be easily adapted for either manual or motorized use.

SUMMARY OF PRESENT DEVELOPMENT

In accordance with one aspect of the present development, a french door hinge system for an oven includes a door movement control plate adapted to be connected to an associated french door oven. The door movement control plate includes a door movement slot including an inner portion and an outer portion. A door movement control linkage includes first and second door links. The first and second door links include: (i) respective outer ends adapted to be operatively engaged with first and second french doors of the associated french door oven; and, (ii) respective first and second inner ends operatively engaged with the door movement slot. The door movement control linkage further includes a pivot link operatively engaged with the first and second door links such that pivoting movement of the pivot link corresponds to movement of the inner ends of the first and second door links relative to the slot. The pivot link pivots about a pivot axis between: (i) a first position in which the inner ends of the first and second door links are engaged with the inner portion of the door movement slot; and, (ii) a second position in which the inner ends of the first and second door links are engaged with the outer portion of the door movement slot.

In accordance with another aspect of the present development, a french door oven includes a body defining a cooking chamber with an open mouth. First and second doors are respectively connected to the body adjacent opposite first and second opposite lateral sides of the mouth and are adapted to pivot about respective first and second vertical pivot axes between an opened position in which the first and second doors are pivoted away from the mouth and a closed position in which the first and second doors cover the mouth and define a seam between their adjacent respective inner edges. The oven includes a door movement control system for controlling movement of the doors between their opened and closed positions. The door movement control system includes a door movement control plate including a door movement slot including an inner portion and an outer portion, the outer portion closer to the mouth than the inner portion. The door movement control system further includes a door movement control linkage with first and second door links. The first and second door links include: (i) respective outer ends operatively engaged with the first and second doors; and, (ii) respective first and second inner ends operatively engaged with the door movement slot. The door movement control linkage also includes a pivot link operatively engaged with the first and second door links such that pivoting movement of the pivot link corresponds to movement of the inner ends of the first and second door links relative to the slot, wherein the pivot link pivots about a pivot axis between: (i) a first position in which the inner ends of the first and second door links are engaged with the inner portion of the door movement slot; and, (ii) a second position in which the inner ends of the first and second door links are engaged with the outer portion of the door movement slot.

DETAILED DESCRIPTION OF PRESENT DEVELOPMENT

Figure 1:
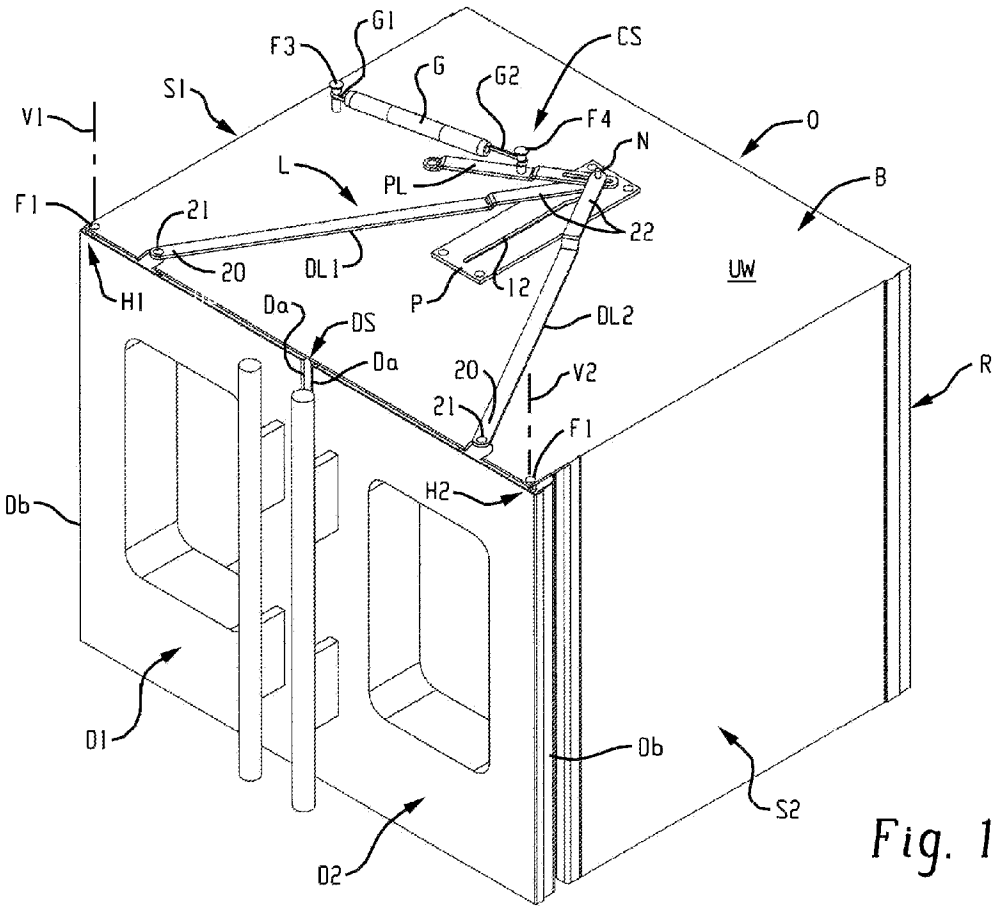
FIGS. 1, 2 and 3 show a french door oven including a hinge system in accordance with the present development, with the oven doors in closed, partially opened and fully opened positions, respectively.
Figure 2:
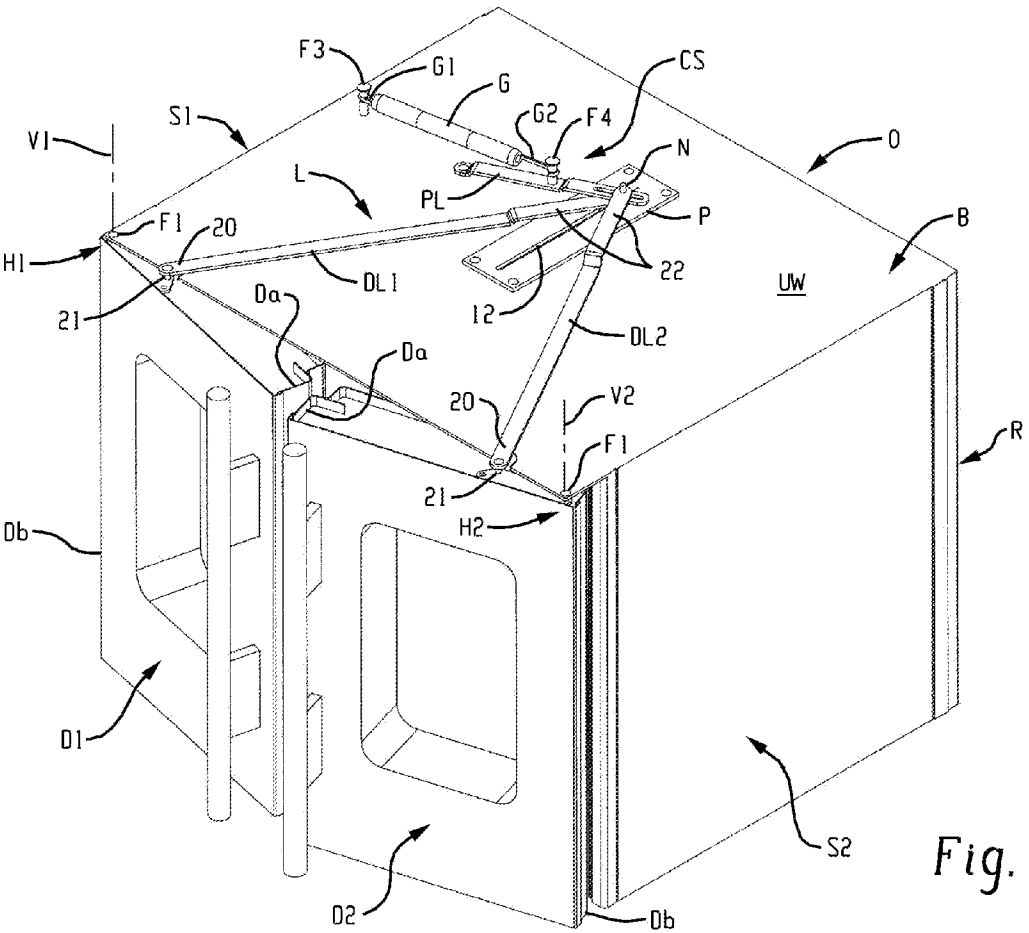
Figure 3:
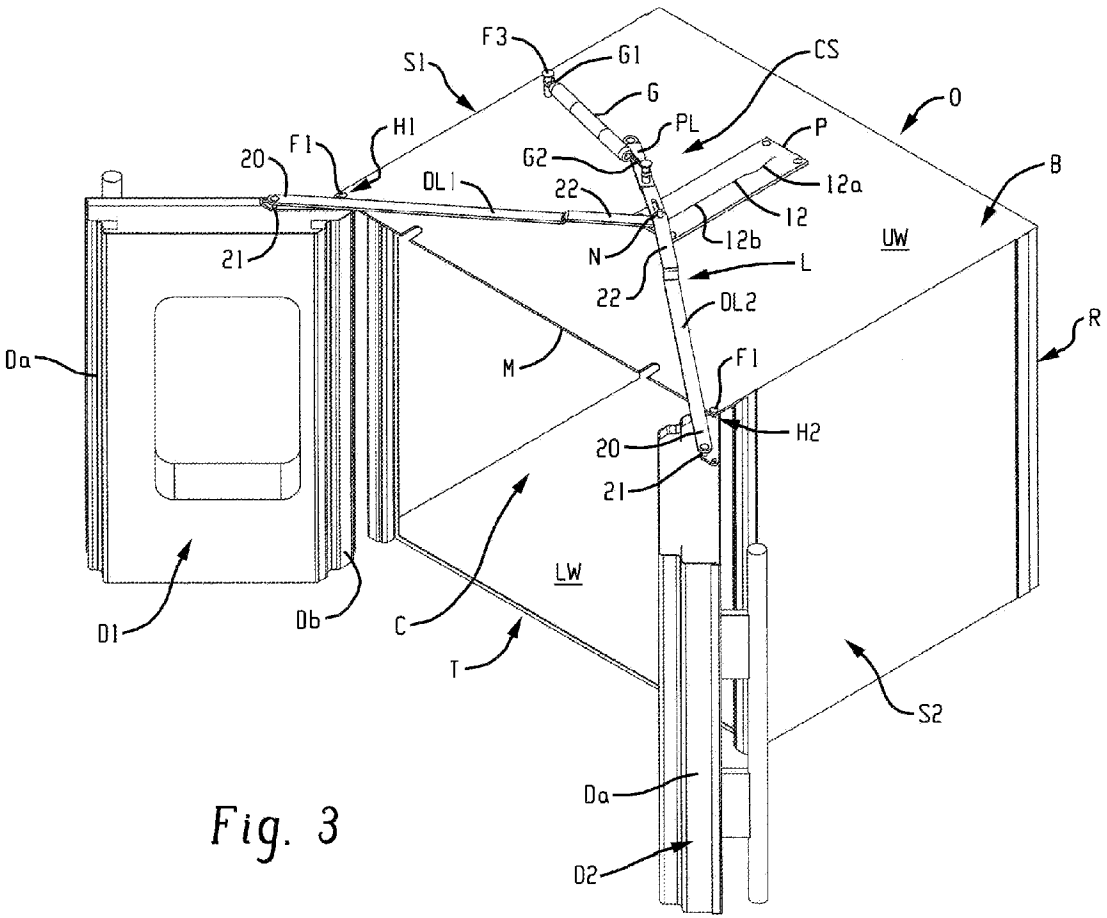

FIGS. 1-3 show a french door style oven O including a hinge system in accordance with the present development. The oven includes a body B in which a cooking chamber C (FIG. 3) is defined. The cooking chamber C includes an open mouth M that provides access to the cooking chamber. The location of the mouth M defines a front T of the cooking oven O and the rear R of the oven O is opposite the front T. The mouth M of the cooking chamber C is selectively opened and closed by first and second oven doors D1,D2 connected adjacent first and second lateral sides S1,S2 of the body. The first and second doors D1,D2 are pivotally connected adjacent the first and second lateral sides S1,S2 of the body B and pivot about respective first and second vertical pivot axes V1,V2. The respective inner edges Da of the doors D1,D2 meet and seal together at a seam DS when closed. The seam DS typically runs parallel to the first and second vertical axes V1,V2 but can be otherwise oriented, e.g., diagonal, stepped, etc. In accordance with the hinge system of the present development, any suitable known hinge structures H1,H2 are used to pivotally secure the respective outer edges Db of the doors D1,D2 to the oven body B. As shown herein, e.g., each hinge structure H1,H2 comprises at least one rivet, pin, or like fastener F1 that pivotally connects the outer edge Db of each door D1,D2 to the oven body B.

It has been deemed desirable to provide a system for controlling the movement of the french doors D1,D2 to and between their closed positions (FIG. 1) where they cooperate to seal the mouth M of the cooking chamber C, and their opened positions (FIG. 3) where they are pivoted open a maximum extent to unblock the mouth M of the cooking chamber C. FIG. 2 shows the doors D1,D2 in an intermediate position between the opened and closed positions, where the doors D1,D2 are only partially opened/closed. More particularly, it has been deemed desirable to provide a system that ensures:

(i) if one of the doors D1,D2 is manually opened/closed, the other door D1,D2 opens/closes in a corresponding manner;

(ii) when the doors D1,D2 move from their opened to their closed positions, they mate at the seam DS in a predetermined sequence to improve and simplify the design of the heat seal required at the seam DS;

(iii) a pull-in force is exerted on the doors D1,D2 when they are closed or nearly closed to eliminate the need for a latching or like mechanism acting between the doors D1,D2;

(iv) an opening force is exerted on the doors D1,D2 when they are opened beyond a minimum opening point (e.g., 90 degrees relative to their closed positions) so that once the doors D1,D2 are opened manually beyond the minimum opening point, they automatically move to their fully opened positions without requiring further manual opening force;

(v) ease of adaptation to for motorized movement of the doors D1,D2.

Accordingly, a hinge system for french doors in accordance with the present development further comprises a door movement control system CS. The door movement control system CS comprises a door movement control linkage L, a door movement control plate P, and a door movement control spring G that cooperate to meet the above requirements and to provide additional advantages.

Figure 4:
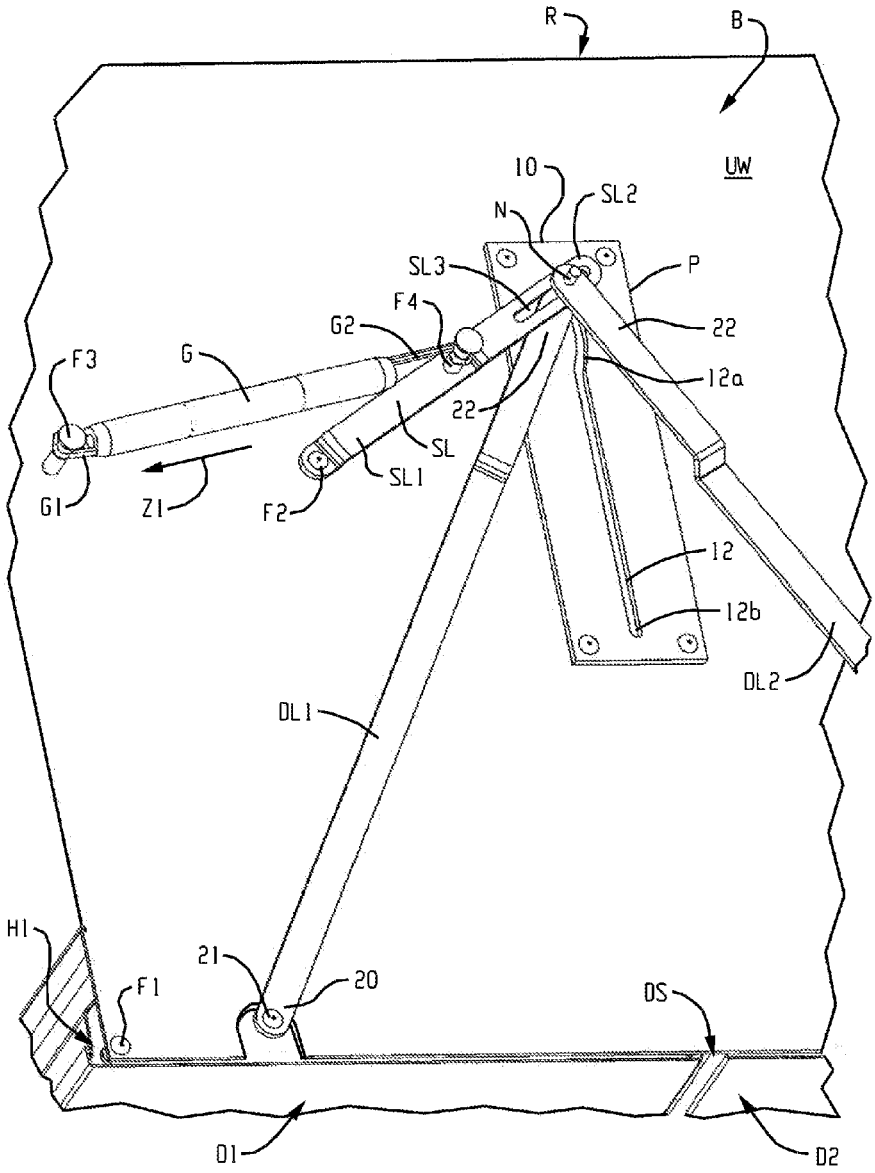
FIGS. 4 and 5 are enlarged partial views of the oven of FIGS. 1-3 showing the door movement control plate P and related components of the hinge system.
Figure 5:
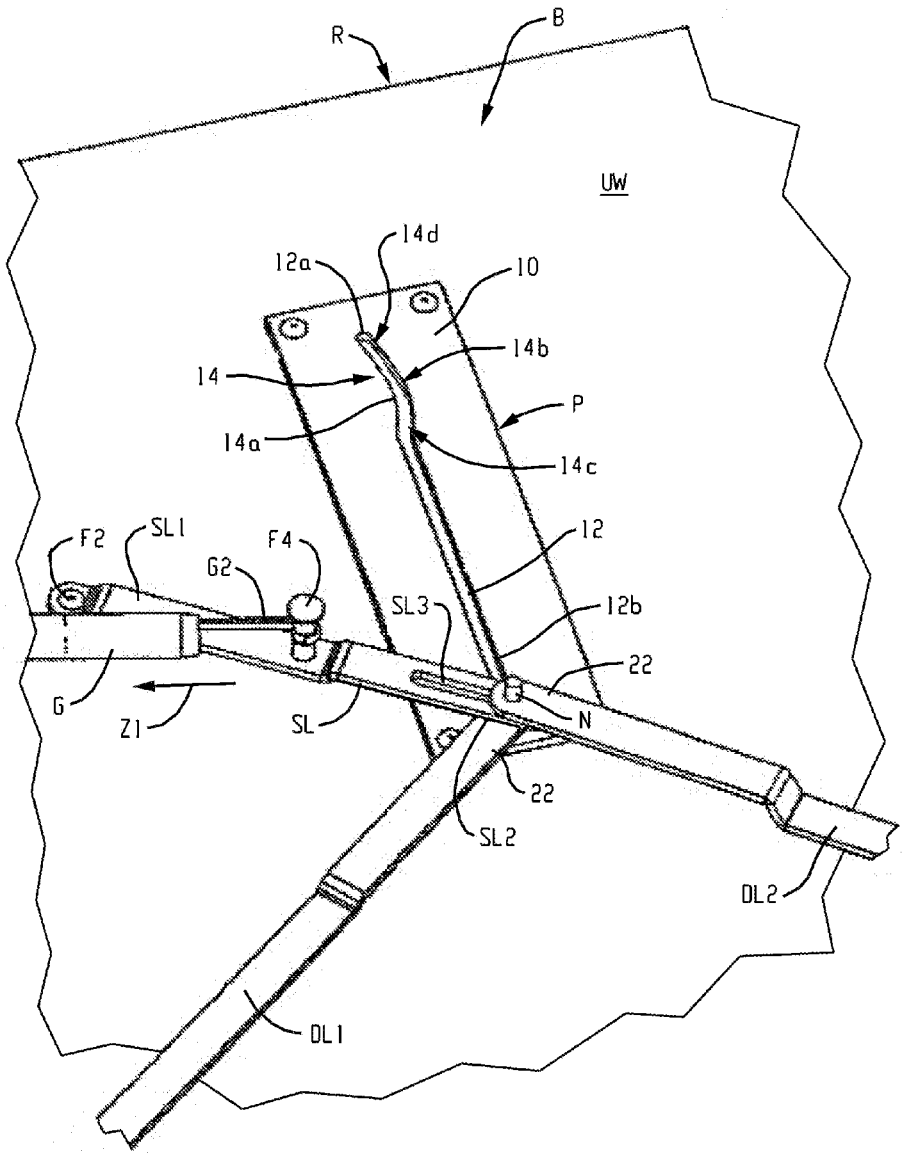

With reference also to FIGS. 4 and 5, the door movement control plate P comprises a metal or other plate member 10 in which a door movement control slot 12 is defined. The control slot 12 is shaped so as to include an inner portion 12*a* (closer to the rear R of the oven O) and an outer portion 12*b* extending outwardly (forwardly) away from the inner portion 12*a* toward the mouth M of the cooking chamber C. As described in further detail below, in the illustrated embodiment, the inner portion 12*a* of the control slot 12 is curved or contoured to control movement of the doors D1,D2 relative to each other and for added pull-in force, and the outer portion 12*b* is linear. The door movement control plate P is immovably mounted to or adjacent a horizontal upper wall UW above the cooking chamber C, but it could alternatively be immovably mounted to or adjacent a horizontal lower wall LW (FIG. 3) below the cooking chamber C. The plate P is, however, preferably always mounted in a fixed horizontal orientation as shown such that the entire control slot 12 lies in a single horizontal plane. In an alternative embodiment, the door movement control plate P is integral with and/or defined as part of a wall of the oven O, e.g., the control slot 12 can alternatively be defined directly in the horizontal upper wall UW.

With continuing reference to all of FIGS. 1-5, the door movement control linkage L comprises first and second door links DL1,DL2 that include respective outer ends 20 pivotally connected to or otherwise operatively engaged with the first and second doors D1,D2 at locations 21 spaced a like distance inward from the respective vertical pivot axes V1,V2 between the inner and outer edges Da,Db of the doors D1,D2. The first and second door links DL1,DL2 also include respective inner ends 22 that are each operatively engaged with the control slot 12 of the plate P. As shown herein, the respective inner ends 22 are pivotally connected to a follower pin N that is slidably engaged with the control slot 12 of the plate P. The inner ends 22 of the door links DL1,DL2 are preferably captured on/to the pin N so that they cannot lift off of the pin N and the pin N is preferably slidably captured in the control slot 12, for example, by using a rivet or the like to define the pin N or simply by enlarging, bending and/or otherwise deforming the ends of the pin N. Those of ordinary skill in the art will recognize that manual pivoting movement of the doors D1,D2 to and between the opened and closed positions as shown in FIGS. 1-3 causes the outer ends 20 of door links DL1, DL2 to move with and pivot relative to the respective doors D1,D2, and causes the inner ends 22 of door links DL1,DL2 to move with and pivot relative to the follower pin N as the follower pin slides in the control slot 12 between the inner and outer portions 12*a*,12*b* of the control slot 12. The first and second door links DL1,DL2 are preferably symmetrically connected to the doors D1,D2 in the sense that the distance between the follower pin N and the door connection point 21 is equal for both door links DL1,DL2, and the distance between each door pivot axis V1,V2 and the respective door connection point 21 is equal.

The door movement control linkage system L further comprises a pivot link PL that pivots about a fixed vertical axis. More particularly, again as best seen in FIGS. 4 and 5, the pivot link PL has a first end PL1 pivotally secured to a fixed location, e.g., the horizontal upper wall UW using a rivet, pin, or other fastener F2 that defines a vertical pivot axis for the pivot link PL. The opposite, second end PL2 of the pivot link PL is operatively engaged with the inner ends 22 of both door links DL1,DL2. As shown herein, the second end PL2 of the pivot link PL includes or defines an elongated slot PL3 in which the follower pin N is slidably received in order to couple or engage the pivot link PL operably to the inner ends 22 of the first and second door links DL1,DL2. In the illustrated embodiment, the second end PL2 of the pivot link is located between the inner ends 22 of the door links DL1,DL2. Sliding movement of the follower pin N in the control slot 12 causes the pivot link PL to pivot about the fastener F2 (or pivoting movement of the pivot link PL causes sliding movement of the follower pin N in the control slot 12), while the elongated slot PL3 of the pivot link PL accommodates changes in the distance between the pivot link pivot fastener F2 and the follower pin N as the pivot link PL pivots and the follower pin N moves in the control slot 12. The pivot link PL thus pivots from first (door closed) position (FIG. 4), where the follower pin N is moved a maximum extent into the inner end 12*a* of the control slot 12, to a second (door opened) position (FIG. 5), where the follower pin N is moved a maximum extent into the outer end 12*b* of the control slot. The door links DL1,DL2 and pivot link PL are defined from metal stampings or the like.

A biasing means such as a spring G influences movement of the pivot link PL. In particular, the spring G or other biasing means exerts a pulling force on the pivot link PL that urges the pivot link PL toward either its first (door closed) or second (door opened) position depending upon the location of the follower pin N in the slot. As shown, the spring G is a tension spring such as a metal coil spring having a first end G1 anchored to a fixed location such as the cooking chamber upper wall UW using a rivet or other fastener F3, and an opposite second end G2 connected to the pivot link PL, preferably between the first and second ends PL1,PL2 of the pivot link using a fastener F4 or other means, e.g., by providing a hook at the second end G2 of the spring that engages an aperture of the pivot link PL. The spring G thus exerts a tension biasing force between its ends G1,G2 as indicated by the force vector arrow Z1 in FIGS. 4 and 5. The illustrated tension spring G is one example only, and it is not intended that the present development be limited to the illustrated spring G.

Those of ordinary skill in the art will recognize that the spring G and pivot link PL define a neutral or center position when the spring biasing force vector Z1 (FIGS. 4 and 5) is aligned or coincident with the pivot link pivot axis as defined by the pivot link pivot fastener F2. It will also be recognized by those of ordinary skill in the art that when the pivot link PL pivots through this neutral or center position in either direction the spring G and pivot link PL go "over-center" in the sense that the force of the spring G will act on the pivot link PL to pivot the pivot link PL toward its first or second position, depending upon which side of the neutral or center position the pivot link PL is located, with corresponding movement of the follower pin N in the control slot 12 to either the inner or outer portion 12*a*,12*b* which, in turn, causes the door links DL1,DL2 to exert a closing or opening force on the french doors D1,D2. Accordingly, when the doors D1,D2 are closed, a user need only manually open one or both of the doors D1,D2 sufficiently such that the pivot link PL moves beyond its neutral or center position (to a location between its neutral position and its second (door opened) position), after which the spring G will move the pivot link to its second (door opened) position without further manual opening force exerted on the door(s) by the user. Likewise, when the doors D1,D2 are opened, a user need only manually close one or both of the doors D1,D2 sufficiently such that the pivot link PL moves beyond its neutral or center position (to a location between its neutral position and its first (door closed) position), after which the spring G will move the pivot link to its first (door closed) position without further manual closing force exerted on the door(s) by the user. In one embodiment, the linkage system L is designed so that the neutral/center position of the pivot link PL corresponds to the doors D1,D2 being opened 90 degrees relative to their fully closed positions.

As is easily seen in FIG. 5 and elsewhere, the inner portion 12*a* of the control slot 12 is contoured to enhance performance of the door movement control system CS. In particular, the inner portion 12*a* is shaped to include a curved region 14 having a concave side 14*a* oriented toward the spring G and toward the pivot axis of the pivot link PL as defined by the pivot fastener F2, and an opposite convex side 14*b*. When the follower pin N is moving from the linear outer portion 12*b* of the control slot 12 into the curved inner portion 12*a* of the control slot as the doors D1,D2 are closing, a forward portion 14*c* of the curved slot region 14 first causes the follower pin N to move on a path that draws the first door D1 closed more quickly as compared to the second door D2, to ensure that the first door D1 always closes before the second door. Secondly, a rear portion 14*d* of the curved region 14 defines a path that angles slightly inward relative to the pivot link pivot fastener F2 so that the spring G can more forcibly urge the pivot link PL into its first (door closing) position which causes the door links DL1,DL2 to exert a greater closing force on the doors D1,D2 so that no supplemental latch is required to secure the doors D1,D2 in their closed positions.

Figure 6:
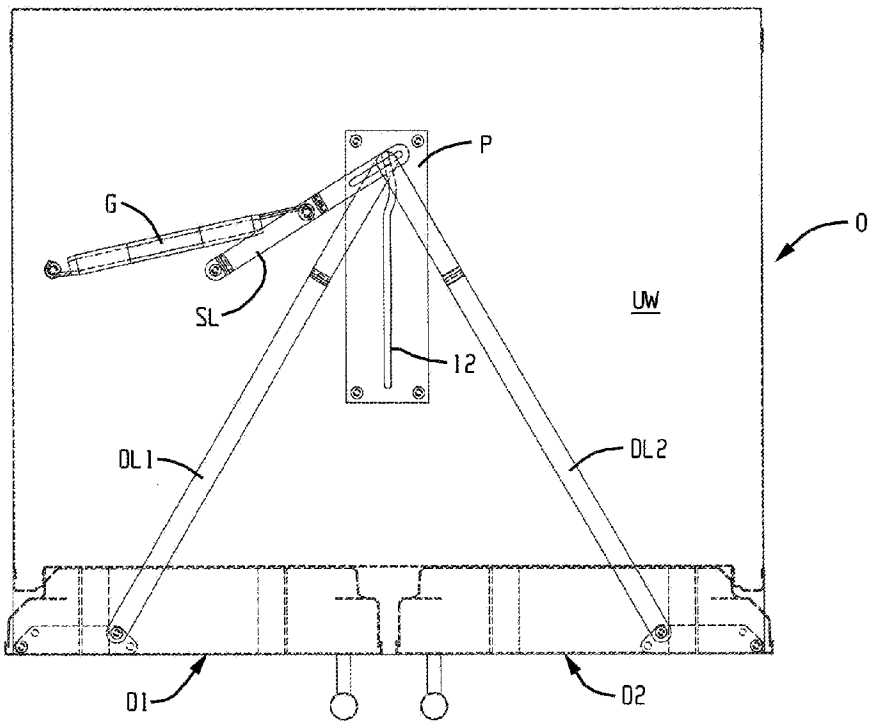
FIGS. 6, 7 and 8 are top views of the oven that correspond respectively to FIGS. 1, 2 and 3.
Figure 7:
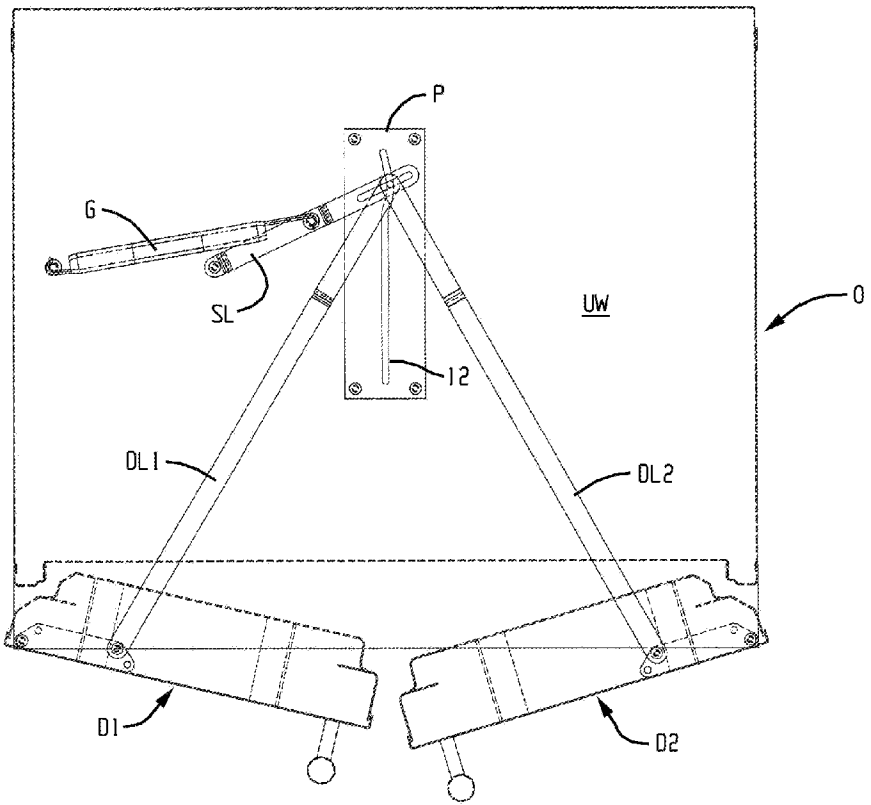
Figure 8:
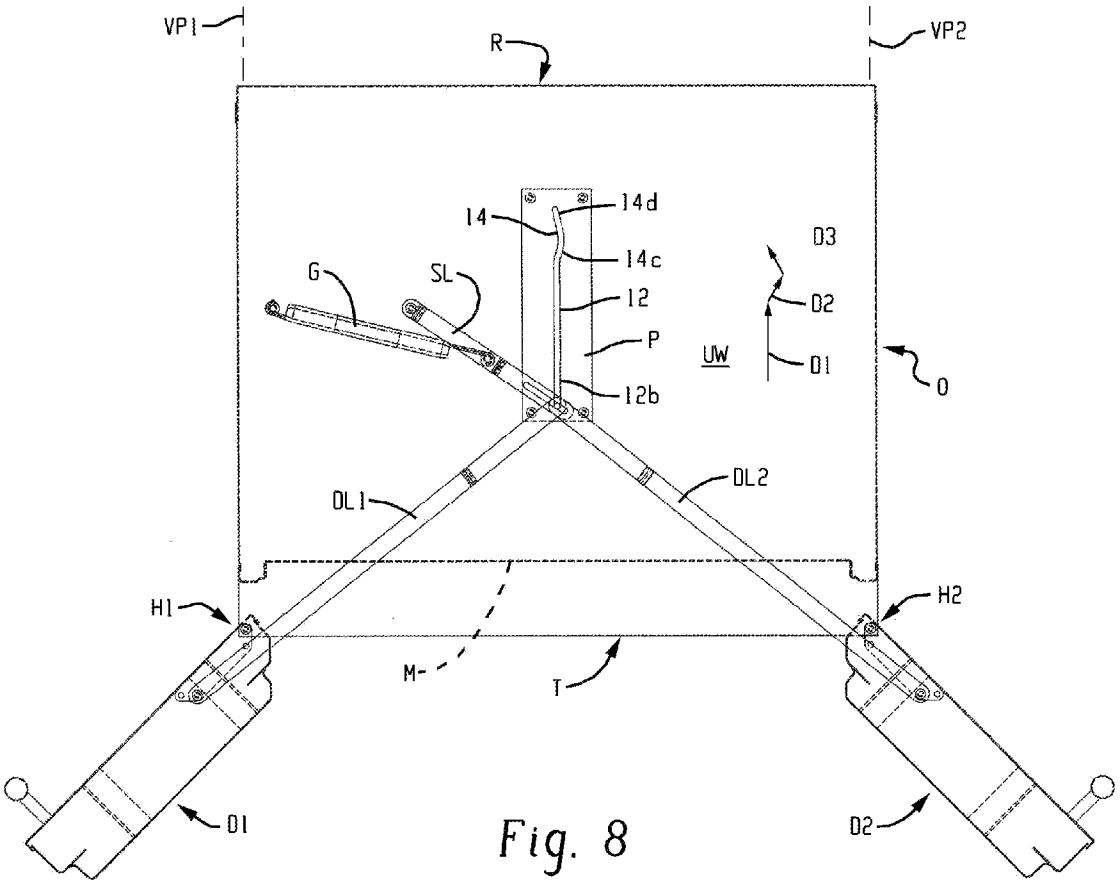

FIGS. 6, 7 and 8 provide a top view of the oven O of FIGS. 1-3. As shown in FIG. 8, the first and second vertical pivot axes V1,V2 lie in respective first and second parallel, spaced-apart vertical reference planes VP1,VP2. The linear outer portion 12*b* of the door movement control slot 12 defines a path that lies midway between the first and second reference planes VP1,VP2 and that extends in a direction D1 away from the cooking chamber mouth M parallel to the first and second reference planes VP1,VP2. The forward portion 14*c* of the inner curved slot region 14 defines a path that begins adjacent the linear outer portion 12*b* and that extends in a direction D2 away from the first reference plane VP1 while still moving away from the mouth M of the cooking chamber C. The rear portion 14*d* of the inner curved slot region 14 defines a path that begins adjacent the forward curved portion 14*c* and that extends in a direction D3 away from the second reference plane VP2 while still moving away from the mouth M of the cooking chamber C. Those of ordinary skill in the art will recognize that when the follower pin N is moving in the slot 12 in the direction D1, the doors D1,D2 will move toward their closed positions symmetrically given the symmetrical geometry of the door links DL1,DL2 as described above. When the follower pin N moves in the direction D2 in the forward curved portion 14*c* of the slot 12, the doors D1,D2 will move further toward their closed positions, but will move asymmetrically with the door D1 closing ahead of the door D2. Finally, when the follower pin N moves in the direction D3 in the rear curved portion 14*d* of the slot 12, both doors D1,D2 will move completely to their closed positions. The rear curved portion 14*d* of the slot 12 also serves to increase the pull-in force exerted on the doors D1,D2 via door links DL1,DL2 in that it defines a dwell region for the follower pin N that requires that the biasing force Z1 of the spring G be overcome by elongating the biasing spring G in order for the pin N to move in the reverse (door opening) direction from the rear curved portion 14*d* to the forward curved portion 14*c* of the slot 12 (and ultimately to the linear outer portion 12*b* of the slot).

Figure 9:
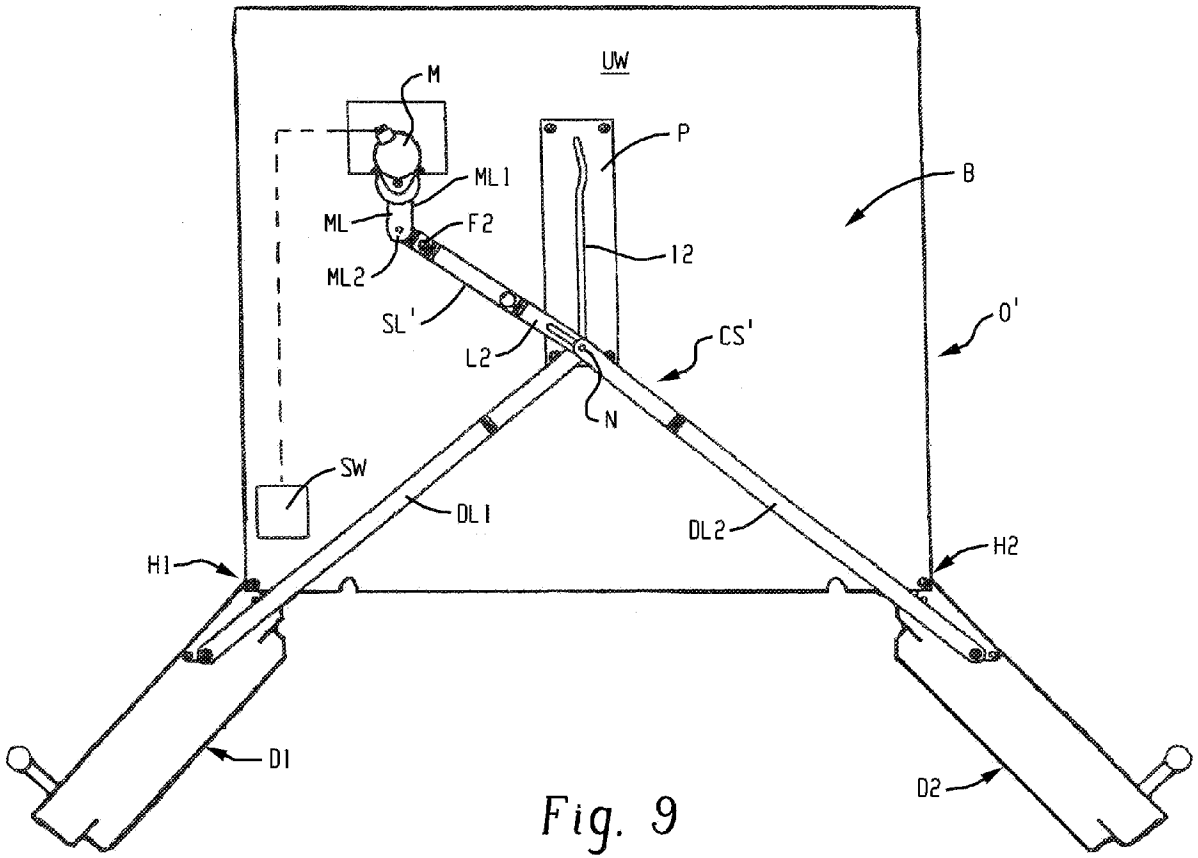
FIG. 9 illustrates an alternative embodiment hinge system for a french door oven, wherein the hinge system is similar to that shown in FIGS. 1-8 but includes a powered actuator and a control system for same.

FIG. 9 discloses an alternative embodiment that is identical to that disclosed in FIGS. 1-8 except that the illustrated oven O' includes an alternative door movement control system CS' in which a powered actuator M such as an electric motor, a fluid cylinder, solenoid, or the like is secured to the upper wall UW or another mounting location and operably connected to a pivot link PL', e.g., by way of a motor link ML. The illustrated motor link ML has a first end ML1 pivotally connected to a rotating output wheel/disc/arm or the like of the motor M and a second end ML2 pivotally connected to the alternative pivot link PL' for which the pivot axis defined by the fastener F2 is located between the opposite ends PL1,PL2 of the pivot link such that rotating movement of the motor link first end ML1 as driven by the output of the motor M induces reciprocating pivoting movement of the pivot link PL' about the pivot axis defined by the fastener F2 and, thus, movement of the follower pin N in slot 12 and also movement of the door links DL1,DL2 to open/close the doors D1,D2 under force of the motor M. The oven O includes a control system comprising one or more switches SW for user control of the powered actuator M. The switch SW can be a manually operable switch, a voice activated switch, a motion sensor switch, a remote control switch, or any other suitable switch that selectively actuates and controls the powered actuator M. In the illustrated alternative embodiment, the powered actuator M is provided in place of the spring G, but the powered actuator can be provided in addition to the spring G. The powered actuator M is selectively operable to pivot the pivot link PL' to and between its first (door opened) and second (door closed) positions in response to user input via switch SW in order to open and close the doors D1,D2 without any required manual movement of the doors D1,D2 by a user. The motor or other powered actuator M is configured with a clutch or other mechanism or is allowed to be back-driven by movement of the pivot link PL such that manual opening and closing of the doors D1,D2 is still possible.

The development has been described with reference to preferred embodiments, but it should not be limited to these preferred embodiments. Instead, the invention should be construed in the broadest possible manner allowed by law both literally and according to the doctrine of equivalents.

The invention claimed is:

1. A French door hinge system for an oven, said hinge system comprising:

a door movement control plate adapted to be connected to an associated French door oven, said door movement control plate including a door movement slot including an inner portion and an outer portion;

a door movement control linkage comprising:

first and second door links, said first and second door links comprising: (i) respective outer ends adapted to be operatively engaged with first and second French doors of the associated French door oven; and, (ii) respective first and second inner ends operatively engaged with said door movement slot;

a pivot link operatively engaged with said first and second door links such that pivoting movement of said pivot link corresponds to movement of said inner ends of said first and second door links relative to said slot, wherein said pivot link pivots about a pivot axis between: (i) a first position in which the inner ends of the first and second door links are engaged with said inner portion of said door movement slot; and, (ii) a second position in which the inner ends of the first and second door links are engaged with said outer portion of said door movement slot.

2. The French door hinge system as set forth in claim 1, further comprising:

a spring operatively coupled to the pivot link, said spring biasing said pivot link toward its first position when said pivot link is located between its first position and a neutral position, and said spring biasing said pivot link toward its second position when said pivot link is located between its second position and the neutral position.

3. The French door hinge system as set forth in claim 2, wherein said spring defines a biasing force vector with respect to said pivot link, and wherein said neutral position of said pivot link is defined when said biasing force vector is aligned with said pivot axis of said pivot link.

4. The French door hinge system as set forth in claim 1, wherein said outer portion of said door movement slot comprises a linear portion for symmetrical movement of said first and second door links relative to said door movement slot and said inner portion of said door movement slot comprises a curved region for asymmetrical movement of said first and second door links relative to said door movement slot.

5. The French door hinge system as set forth in claim 4, further comprising a powered actuator operably engaged with the pivot link for selectively moving the pivot link between its first and second positions.

6. The French door hinge system as set forth in claim 4, further comprising:

a spring operably coupled to the pivot link, said spring biasing said pivot link toward its first position when said pivot link is located between its first position and a neutral position, and said spring biasing said pivot link toward its second position when said pivot link is located between its second position and the neutral position.

7. The French door hinge system as set forth in claim 6, wherein said curved region of said door movement slot comprises a concave side oriented toward the pivot axis of the pivot link.

8. The French door hinge system as set forth in claim 1, wherein said first and second inner ends of said first and second door links are connected to a follower pin, and said follower pin is slidably engaged with said slot.

9. The French door hinge system as set forth in claim 8, wherein said pivot link is engaged with said follower pin and said pivot link accommodates a variable distance between said pivot axis and said following pin when said pivot link moves between its first and second positions.

10. The French door hinge system as set forth in claim 9, wherein said pivot link comprises an elongated slot in which said follower pin is located for relative sliding movement between the follower pin and the pivot link.

11. The French door hinge system as set forth in claim 9, further comprising:

a biasing spring having a first end operatively coupled to a fixed location and having a second end operatively coupled to the pivot link between the pivot axis and the follower pin.

12. The French door hinge system as set forth in claim 1, further comprising a powered actuator operably engaged with the pivot link for selectively moving the pivot link between its first and second positions.

13. The French door hinge system as set forth in claim 12, further comprising a user input switch for selectively activating said powered actuator.

14. A French door oven comprising:

a body defining a cooking chamber, said cooking chamber including an open mouth;

first and second doors respectively connected to said body adjacent opposite first and second opposite lateral sides of said mouth and adapted to pivot about respective first and second vertical pivot axes between an opened position in which said first and second doors are pivoted away from said mouth and a closed position in which said first and second doors cover said mouth and define a seam between their adjacent respective inner edges;

a door movement control system for controlling movement of the doors between their opened and closed positions, said door movement control system comprising:

a door movement control plate including a door movement slot including an inner portion and an outer portion, said outer portion closer to said mouth than said inner portion;

a door movement control linkage comprising:

first and second door links, said first and second door links comprising: (i) respective outer ends operatively engaged with the first and second doors; and, (ii) respective first and second inner ends operatively engaged with said door movement slot;

a pivot link operatively engaged with said first and second door links such that pivoting movement of said pivot link corresponds to movement of said inner ends of said first and second door links relative to said slot, wherein said pivot link pivots about a pivot axis between: (i) a first position in which the inner ends of the first and second door links are engaged with said inner portion of said door movement slot; and, (ii) a second position in which the inner ends of the first and second door links are engaged with said outer portion of said door movement slot.

15. The French door oven as set forth in claim 14, wherein said door movement control system further comprises:

a spring operatively coupled to the pivot link, said spring biasing said pivot link toward its first position when said pivot link is located between its first position and a neutral position, and said spring biasing said pivot link toward its second position when said pivot link is located between its second position and the neutral position.

16. The French door oven as set forth in claim 15, wherein said spring defines a biasing force vector with respect to said pivot link, and wherein said neutral position of said pivot link is defined when said biasing force vector is aligned with said pivot axis of said pivot link.

17. The French door oven as set forth in claim 14, wherein said outer portion of said door movement slot comprises a linear portion for symmetrical movement of said first and second door links relative to said door movement slot and said inner portion of said door movement slot comprises a curved region for asymmetrical movement of said first and second door links relative to said door movement slot.

18. The French door oven as set forth in claim 17, wherein said door movement control system further comprises:

a spring operably coupled to the pivot link, said spring biasing said pivot link toward its first position when said pivot link is located between its first position and a neutral position, and said spring biasing said pivot link toward its second position when said pivot link is located between its second position and the neutral position.

19. The French door oven as set forth in claim 18, wherein said curved region of said door movement slot comprises a concave side oriented toward the pivot axis of the pivot link.

20. The French door oven as set forth in claim 14, wherein said first and second inner ends of said first and second door links are connected to a follower pin, and said follower pin is slidably engaged with said slot.

21. The French door oven as set forth in claim 20, wherein said pivot link is engaged with said follower pin and said pivot link accommodates a variable distance between said pivot axis and said following pin when said pivot link moves between its first and second positions.

22. The French door oven as set forth in claim 21, wherein said pivot link comprises an elongated slot in which said follower pin is located for relative sliding movement between the follower pin and the pivot link.

23. The French door oven as set forth in claim 21, wherein said door movement control system further comprises:

a biasing spring having a first end operatively coupled to a fixed location and having a second end operatively coupled to the pivot link between the pivot axis and the follower pin.

* * * * *